US008448882B2

(12) United States Patent
Kemmerling et al.

(10) Patent No.: US 8,448,882 B2
(45) Date of Patent: May 28, 2013

(54) SPREADER MOUNT

(75) Inventors: Craig Kemmerling, Twinsburg, OH (US); John Horvat, Willowick, OH (US)

(73) Assignee: Meyer Products, LLC, Cleveland, OH (US)

( * ) Notice: Subject to any disclaimer, the term of this patent is extended or adjusted under 35 U.S.C. 154(b) by 823 days.

(21) Appl. No.: 12/542,745

(22) Filed: Aug. 18, 2009

(65) Prior Publication Data

US 2011/0042477 A1 Feb. 24, 2011

(51) Int. Cl.

| | |
|---|---|
| ***A01C 3/06*** | (2006.01) |
| ***A01C 17/00*** | (2006.01) |
| ***A01C 7/00*** | (2006.01) |
| ***E01C 19/20*** | (2006.01) |
| ***B60R 7/00*** | (2006.01) |

(52) U.S. Cl.
USPC ..... 239/661; 239/650; 239/668; 239/681; 239/687; 224/404

(58) Field of Classification Search
USPC ..... 239/7, 650, 651, 661, 663, 668, 681, 239/687; 224/404
See application file for complete search history.

(56) References Cited

U.S. PATENT DOCUMENTS

| | | | | |
|---|---|---|---|---|
| 3,164,387 | A | 1/1965 | Van Der Lely | |
| 4,175,705 | A | 11/1979 | Dreyer | |
| 4,316,581 | A * | 2/1982 | van der Lely et al. | 239/682 |
| 4,712,717 | A * | 12/1987 | Egerdahl | 239/661 |
| 4,991,781 | A * | 2/1991 | Barbieri | 239/661 |
| 5,375,773 | A | 12/1994 | Lewis | |
| 6,089,478 | A * | 7/2000 | Truan et al. | 239/675 |
| 6,722,590 | B2 * | 4/2004 | Kost et al. | 239/687 |
| 6,978,952 | B2 | 12/2005 | Kost et al. | |
| 7,044,408 | B2 * | 5/2006 | Schoenfeld | 239/659 |
| 2006/0273105 | A1 | 12/2006 | Gamble et al. | |
| 2007/0069044 | A1 | 3/2007 | Sandler et al. | |

OTHER PUBLICATIONS

Mini Jr. Tailgate Spreader, website URL http://www.equipmentspecialists inc.com/ccp51/item--Mini-Jr-Tailgate-Spreader--MEY36006.html, Feb. 26, 2009.

Stand Alone Equipment, website URL http://www.standsalone.com, Feb. 19, 2009.

International Search Report, mail date Dec. 30, 2010, for PCT/US2010/041940, Int'l Filing date Jul. 14, 2010.

Written Opinion, mail date Dec. 30, 2010, for PCT/US2010/041940, Int'l Filing date Jul. 14, 2010.

* cited by examiner

*Primary Examiner* — Ryan Reis
(74) *Attorney, Agent, or Firm* — Roger D. Emerson; Timothy D. Bennett; Emerson Thomson Bennett

(57) ABSTRACT

A spreader assembly used to spread a material held in a hopper onto an associated ground surface may include a spreader mount that: (1) has at least three laterally spaced ground contacting surfaces that support the spreader assembly to a ground surface when the spreader assembly is detached from a vehicle; and, (2) remains attached to the spreader assembly when the spreader assembly is attached to the vehicle.

6 Claims, 5 Drawing Sheets

SPREADER MOUNT

I. BACKGROUND OF THE INVENTION

A. Field of Invention

This invention pertains to the art of spreader assemblies used to spread salt and/or sand onto road surfaces, and more specifically to a spreader assembly that includes a spreader mount that supports the spreader assembly to a ground surface when the spreader assembly is detached from a vehicle and remains attached to the spreader assembly when the spreader assembly is attached to the vehicle.

B. Description of the Related Art

Salt and/or sand spreading is a common practice to maintain roads, parking spaces, and other ground surfaces during the winter months. It is known to use larger vehicles as well as smaller vehicles, such as pickup trucks, to perform this type of service. Numerous types of salt spreaders have been developed to be attached to conventional vehicles. Typically, the spreader is attached to the rear of the vehicle to spread particulate material, such as salt, sand, cinders, etc. onto the ground surface being traveled by the vehicle. One of the more common spreaders employs a hopper having a lower discharge opening through which the particulate material falls onto a rotating spinner plate. Such a spreader is known as a broadcast spreader. By rotating the spinner plate as material is being discharged onto the spinner plate, the particulate material is centrifugally propelled by the spinner plate in a wide pattern onto the ground surface. Typically, a motor is mounted on the spreader to cause the spinner plate to rotate. Typical spreader attachment assemblies used in conjunction with pick-up trucks fasten the spreader to the truck's rear bumper or tailgate.

Vehicles to which spreaders are attached are often capable of multiple uses. For this reason, it is well known to remove the spreader so that the vehicle can be used for non-spreading functions and then reattach the spreader to the vehicle when it is once again desired to use the spreader. Depending on the particular circumstances, it may be necessary to remove then reattach the spreader numerous times within a relatively short period of time. A well known issue with spreaders relates to how they are stored when they are not attached to the vehicle. Typically, a storage frame is provided for this purpose. While such storage frames generally work well for their intended purpose, they have disadvantages. One disadvantage is the space that must be dedicated for the storage frame. Even when the spreader is attached to the vehicle, the storage frame takes up space that could otherwise be used for other purposes. Another disadvantage with known storage frames is that they make it difficult to store the spreader in alternate locations. If the storage frame is in a first location, for example, and it is desired to store the spreader at a second location, then the storage frame must first be moved to the second location before the spreader can be stored there.

What is needed is a spreader mount that remains attached to the spreader at all times. In this case, the spreader can easily be stored at any location that is convenient for the operator. In this way the disadvantages known in the prior art can be overcome.

II. SUMMARY OF THE INVENTION

According to one embodiment of this invention, a spreader assembly comprises: a frame that is attachable to an associated vehicle; a hopper supported to the frame for use in holding an associated material; a spinner mechanism supported to the frame and comprising: a motor and a spinner plate that is rotatable by the motor to spread the associated material held in the hopper onto an associated ground surface; a spreader mount that: (1) comprises at least first, second, and third laterally spaced ground contacting surfaces that support the spreader assembly to the associated ground surface when the spreader assembly is detached from the associated vehicle; and, (2) remains attached to the spreader assembly when the spreader assembly is attached to the associated vehicle; and, a spinner guard member that: (1) is supported to the frame; (2) at least partially encloses the spinner mechanism; (3) extends away from the associated vehicle when the spreader assembly is attached to the associated vehicle; and, (4) comprises the first ground contacting surface.

According to another embodiment of this invention a method comprises the steps of: (A) providing a spreader assembly that comprises: (1) a frame; (2) a hopper supported to the frame for use in holding an associated material; (3) a spinner mechanism supported to the frame and comprising: a motor and a spinner plate that is rotatable by the motor to spread the associated material held in the hopper onto an associated ground surface; (4) a spreader mount that comprises at least first, second, and third laterally spaced ground contacting surfaces; and, (5) a spinner guard member that: is supported to the frame; at least partially encloses the spinner mechanism; extends away from the associated vehicle when the spreader assembly is attached to the associated vehicle; and, comprises the first ground contacting surface; (B) attaching the spreader assembly to an associated vehicle by attaching the frame to the associated vehicle; (C) detaching the spreader assembly from the associated vehicle by detaching the frame from the associated vehicle; and, (D) supporting the spreader assembly to the associated ground surface by placing the first, second, and third ground contacting surfaces onto the associated ground surface.

According to still another embodiment of this invention a spreader assembly comprises: a frame that is attachable to an associated vehicle tailgate; a hopper supported to the frame for use in holding an associated material; a spinner mechanism supported to the frame and comprising: a motor and a spinner plate that is rotatable by the motor to spread the associated material held in the hopper onto an associated ground surface; a spreader mount that: (1) comprises at least first, second, and third laterally spaced ground contacting surfaces that support the spreader assembly to the associated ground surface when the spreader assembly is detached from the associated vehicle; and, (2) remains attached to the spreader assembly when the spreader assembly is attached to the associated vehicle; a spinner guard member that: (1) is supported to the frame; (2) at least partially encloses the spinner mechanism; (3) extends away from the associated vehicle when the spreader assembly is attached to the associated vehicle; and, (4) is substantially U-shaped having a pair of arms that are attached to the frame and a mid-section that comprises the first ground contacting surface; and, wherein the spinner plate has a perimeter and the first, second and third ground contacting surfaces are laterally spaced outside the spinner plate perimeter.

One advantage of this invention is that a spreader can be easily stored at any location that is convenient for the operator.

Another advantage of this invention is that no space is required to be dedicated for a spreader storage frame when the spreader is attached to the vehicle.

Still other benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION OF THE INVENTION

Figure 1:
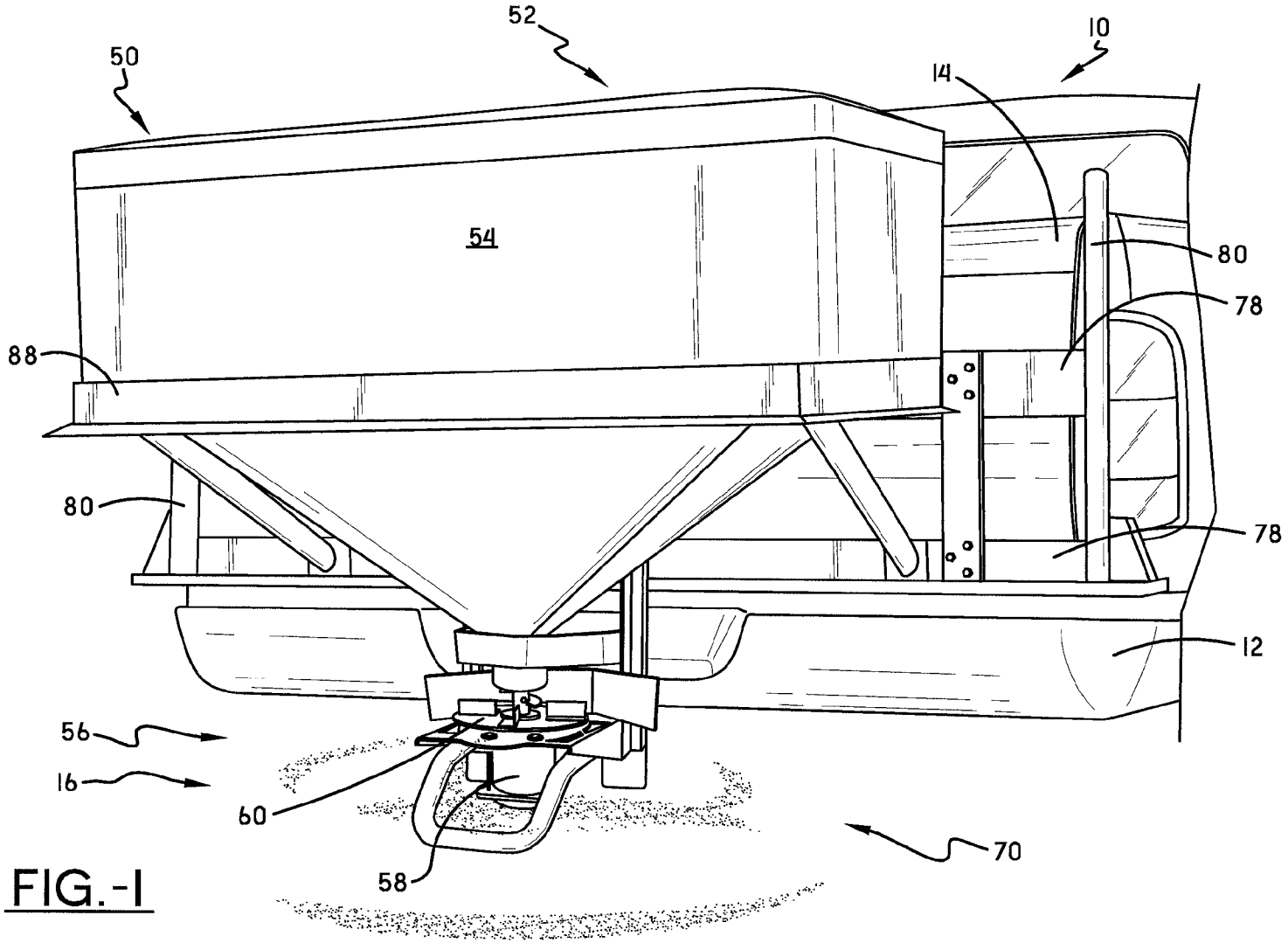
FIG. 1 is a back view of a spreader assembly according to one embodiment of this invention shown attached to the back portion of a vehicle.
Figure 2:
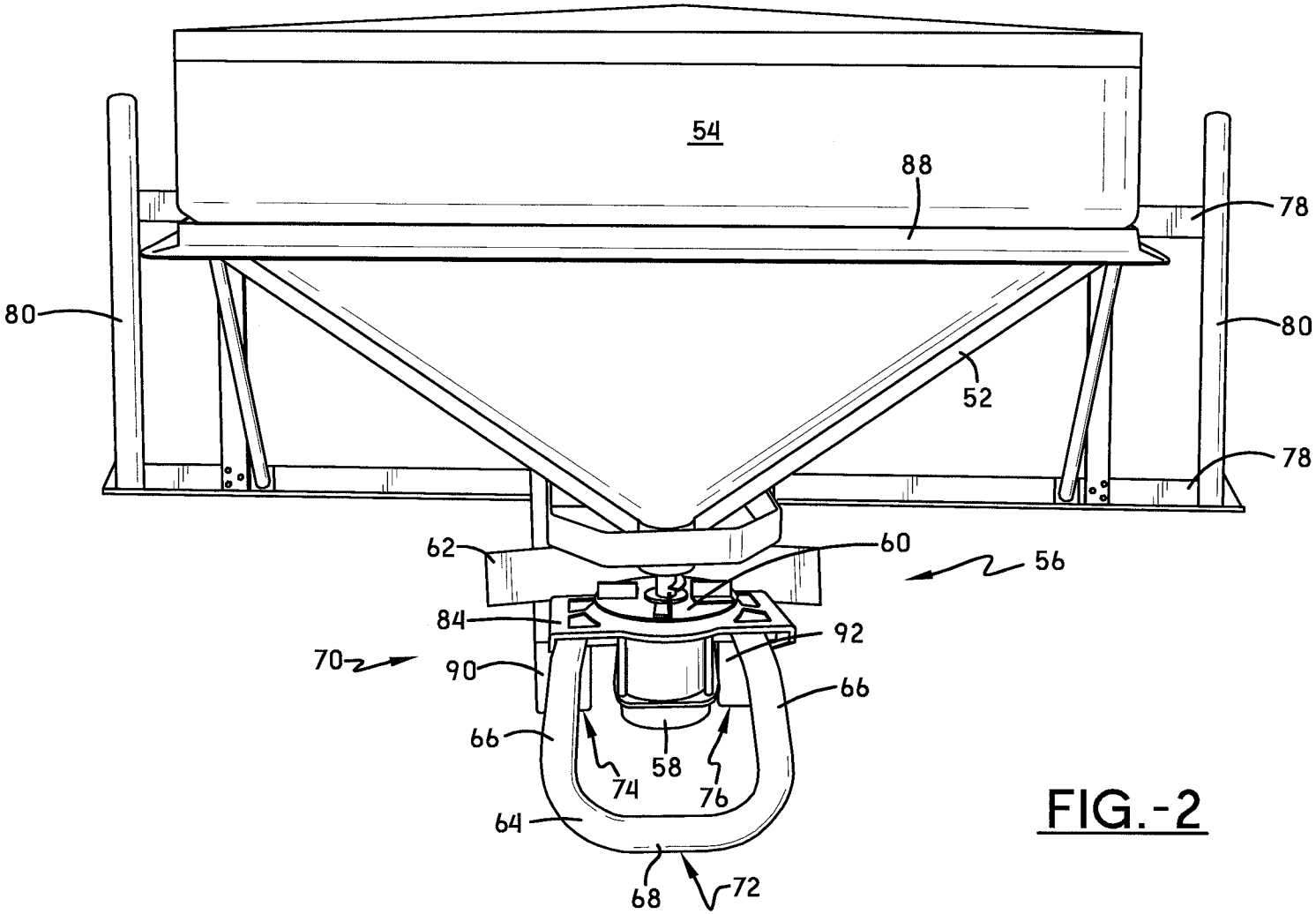
FIG. 2 is a back view of the spreader assembly of FIG. 1 shown detached from the vehicle.
Figure 3:
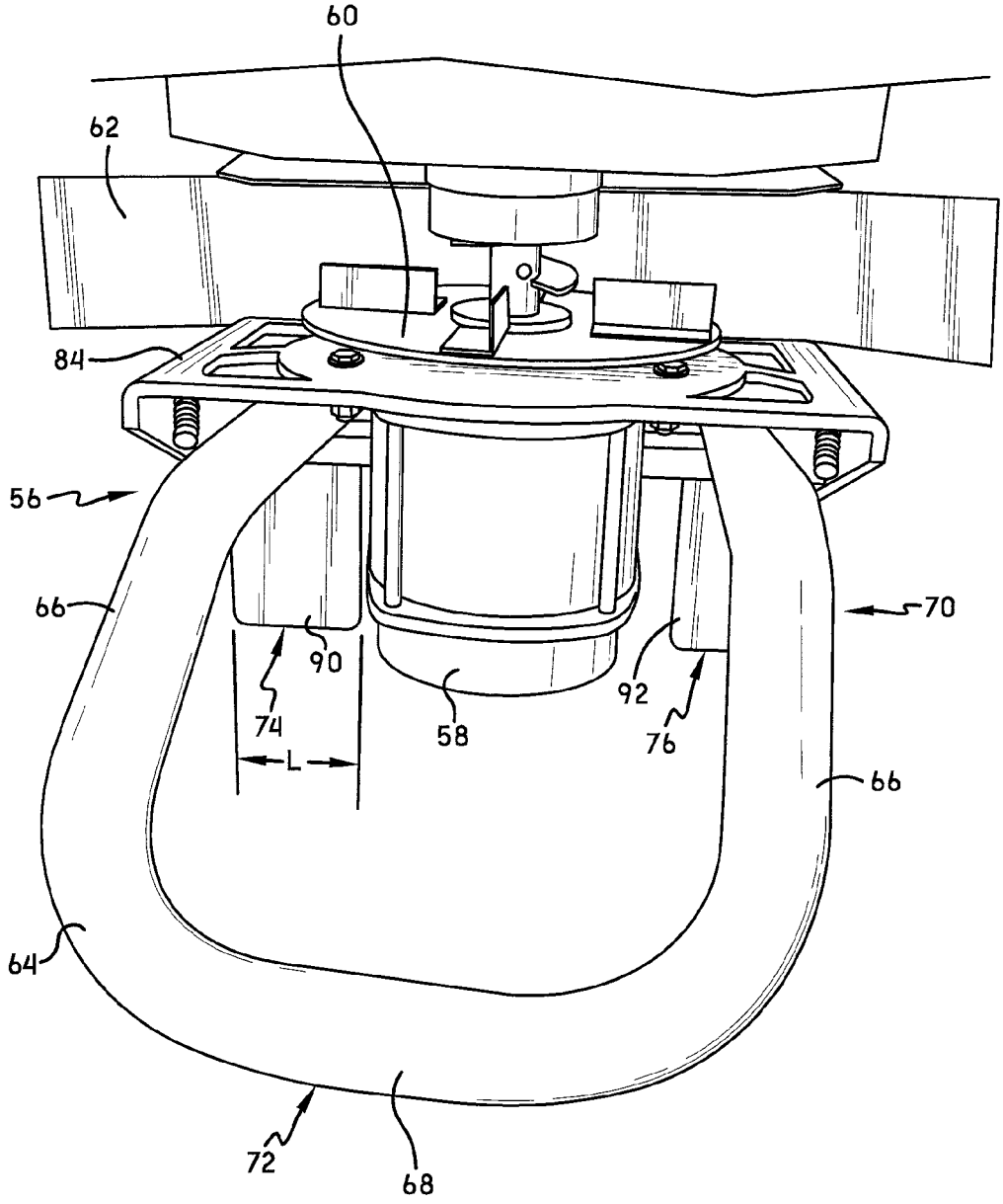
FIG. 3 is a magnified back view of a portion of the spreader assembly shown in FIG. 2.

Referring now to the drawings wherein the showings are for purposes of illustrating embodiments of the invention only and not for purposes of limiting the same, FIG. 1 shows a spreader assembly 50 according to one embodiment of this invention, attached to back end of a vehicle 10. While the vehicle 10 shown is commonly known as a pick-up truck it should be noted that this invention will work with any vehicle chosen with the sound judgment of a person of skill in the art. The vehicle 10 may include a bumper 12, a tailgate 14 and a hitch (not visible but well known to those of skill in the art). Because the spreader assembly 50 is attached to back end of a pick-up truck having a tailgate 14, it is commonly referred to as a tailgate spreader. However, it should be noted that this invention will work with any spreader assembly chosen with the sound judgment of a person of skill in the art.

With reference now to FIGS. 1-5, the spreader assembly 50 may include a frame 52 that is attachable to the vehicle 10, a hopper 54 supported to the frame 52 for use in holding a material to be spread, and a spinner mechanism 56 supported to the frame 52 that is used to spread the material held in the hopper 54 onto any appropriate ground surface 16 including roads, parking spaces, drive ways, sidewalks, and the like. The frame 52 may include a hopper support member 88 to assist in supporting the hopper 54. The material held in the hopper 54 which is to be spread onto the ground surface 16 can be any appropriate for winter weather use chosen with the sound judgment of a person of skill in the art. Some non-limiting examples include salt, sand, and cinders. The hopper 54 can be of any design and formed of any material chosen with the sound judgment of a person of skill in the art. In one specific embodiment, the hopper 54 is formed of polyethylene and the material held within the hopper 54 is salt. The spinner mechanism 56 can be of any design chosen with the sound judgment of a person of skill in the art. For the embodiment shown, the spinner mechanism 56 includes a motor 58 and a spinner plate 60 that is rotatable by the motor 58 to spread the material held in the hopper 54 onto the ground surface 16. A spinner guard member 64 may be provided to guard or protect the spinner mechanism 56 from undesirable forces that would otherwise damage the spinner mechanism 56 or other portion of the spreader assembly 50. The spinner guard member 64 can be of any design chosen with the sound judgment of a person of skill in the art. To improve protection of the spinner mechanism 56, the spinner guard member 64 may at least partially encloses the spinner mechanism 56 and may extend, as shown, away from the vehicle 10 when the spreader assembly 50 is attached to the vehicle 10. For the embodiment shown, the spinner guard member 64 is substantially U-shaped having a pair of arms 66, 66, that are attached to the frame 52 on opposite sides of the spinner mechanism 56 and a mid-section 68. For the embodiment shown, the spinner guard member 64 is formed of a tubular member having a circular cross-section. It is to be understood, however, that for embodiments which use a tubular member, any cross-section chosen with the sound judgment of a person of skill in the art may be used. For the embodiment shown, the spinner guard member 64 is positioned completely below the spinner plate 60.

Figure 4:
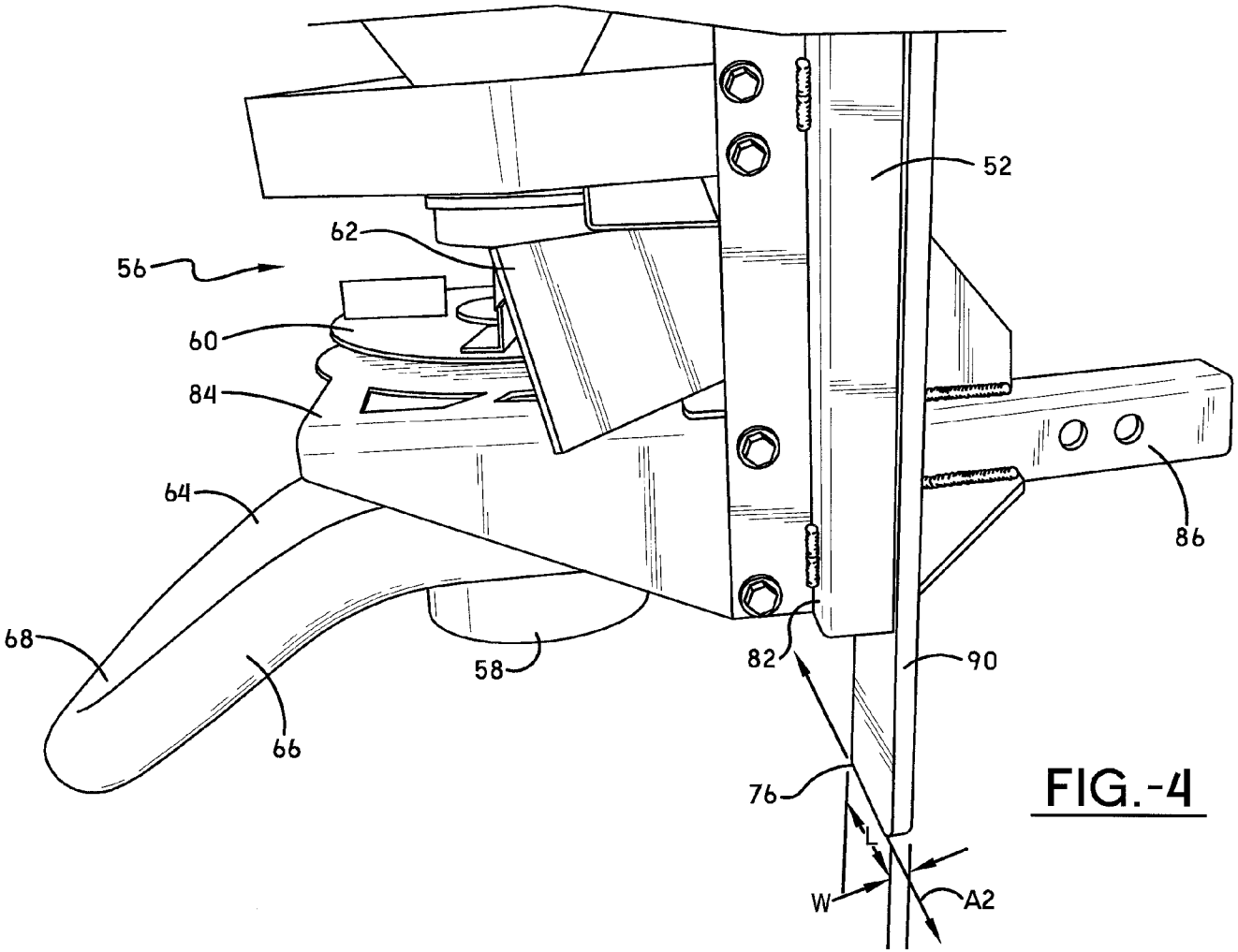
FIG. 4 is a magnified side view of a portion of the spreader assembly shown in FIG. 2.
Figure 5:
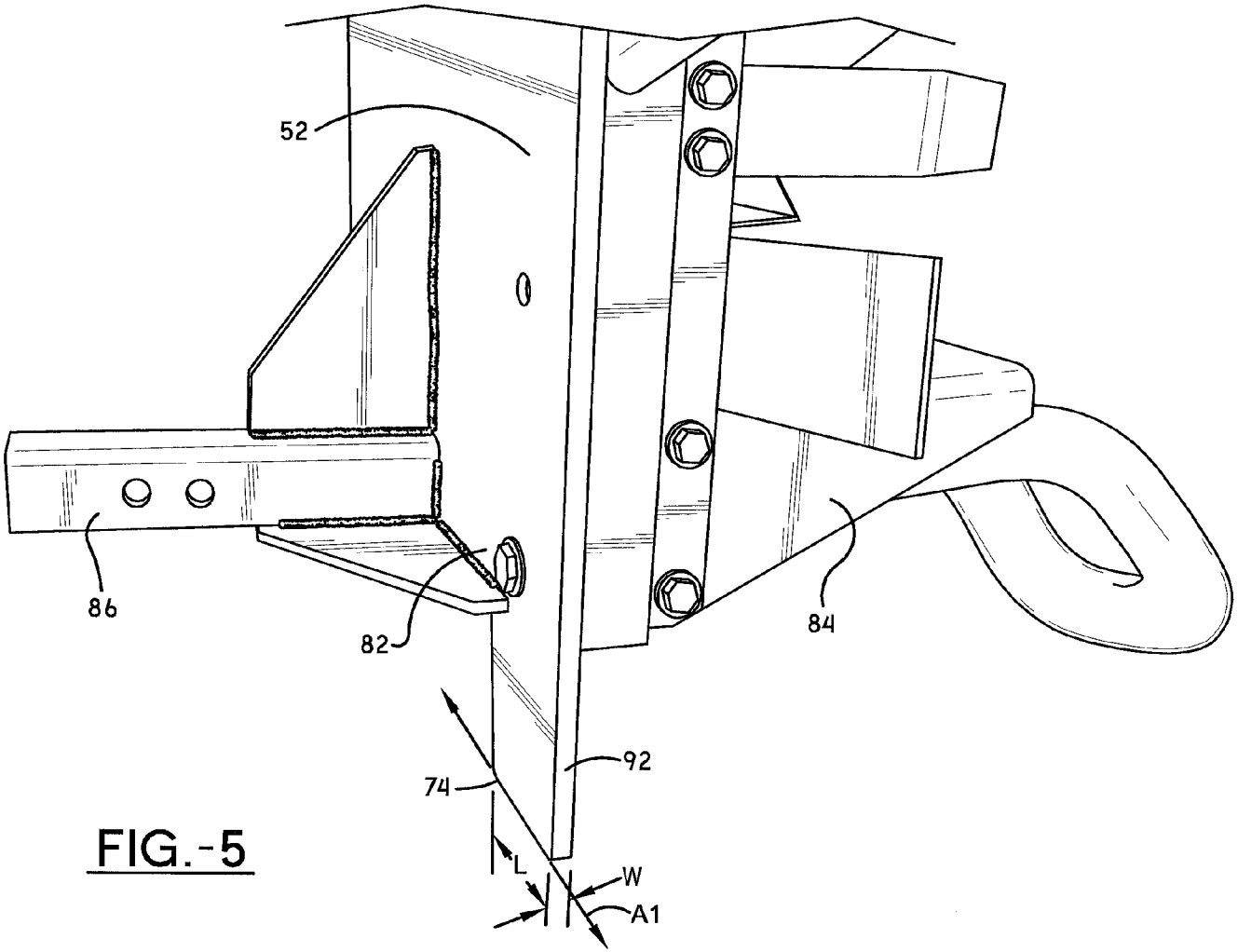
FIG. 5 is a magnified opposite side view of a portion of the spreader assembly shown in FIG. 2.

With reference now to FIGS. 1 and 4-5, the manner in which the frame 52 attaches to the vehicle 10 can be any chosen with the sound judgment of a person of skill in the art. For the embodiment shown, the frame 52 may be connected to a pair of laterally extending members 78, 78 that are attached at their ends to a pair of vertically extending members 80, 80. The lower ends of the vertically extending members 80, 80 may be supported to the bumper 12, as shown. The frame 52 may include a main body 82 and a bracket 84 connected to the main body 82. Extending from the main body may be a vehicle attachment member 86 that attaches to a mounting bracket (not shown) or hitch (not shown) on the vehicle 10. Such attachments are well known and will not be described further here. The spinner mechanism 56 may be connected to the bracket 84, as shown, and the spinner guard member 64 may be connected to the main body 82.

With reference now to FIGS. 1-5, the spreader assembly 50 may also have a spreader mount 70 that: (1) comprises at least first, second, and third laterally spaced ground contacting surfaces 72, 74, 76 that support the spreader assembly 50 to the ground surface 16 when the spreader assembly 50 is detached from the vehicle 10; and, (2) remains attached to the spreader assembly 50 when the spreader assembly 50 is attached to the vehicle 10. In one embodiment, the spinner plate 60 has a perimeter and the first, second and third ground contacting surfaces 72, 74, 76 are laterally spaced outside the spinner plate perimeter. This provides a stable support structure. For the embodiment shown, the first ground contacting surface 72 may be defined on the spinner guard member 64. In one specific embodiment, a bottom surface of the mid-section 68 of the spinner guard member 64 defines the first ground contacting surface 72.

With continuing reference to FIGS. 1-5, the second and third ground contacting surfaces 74, 76 may be formed on the lower ends of corresponding first and second legs 90, 92 that extend downwardly from the main body 82 of the frame 52. In one embodiment, shown, the first, second, and third ground contacting surfaces 72, 74, 76 are coplanar on a plane that is perpendicular to the vertical axis of the hopper 54 so that the spreader assembly 50 keeps the same elevation arrangement when supported on the ground surface 16 as when attached to the vehicle 10. The mid-section 68 of the spinner guard member 64 may be angled downward relative to the arms 66, 66, as shown best in FIG. 4, to accommodate this arrangement. In another embodiment, not shown, the first, second, and third ground contacting surfaces 72, 74, 76 may not be coplanar on a plane that is perpendicular to the vertical axis of the hopper 54 so that the spreader assembly 50 has a different elevation arrangement when supported on the ground surface 16 than when attached to the vehicle 10. The second and third ground contacting surfaces 74, 76 can have any shape chosen with the sound judgment of a person of skill in the art. In one embodiment, shown, they are rectangular in shape. In a more specific embodiment, the second and third ground contacting surfaces 74, 76 have lengths L greater than their widths W. In another specific embodiment, a lengthwise axis A1 of the second ground contacting surface 74 is collinear with a lengthwise axis A2 of the third ground contacting surface 76.

Still referring to FIGS. 1-5, in operation the spreader assembly 50 may attached by attaching the frame 52 to the vehicle 10. If desired, the spreader assembly 50 can be used. More specifically, a control system (not shown) of any conventional type may be used to: (1) clear or release a discharge opening in the bottom of the hopper 54 so that the material falls out onto the spinner plate 60; and, (2) operate the motor 58 to rotate the spinner plate 60 so that the material is centrifugally propelled by the spinner plate 60 onto the ground surface 16. A baffle plate 62 may be used to prevent the material from being propelled toward the vehicle 10. As the operation of a spreader assembly 50 is well known to those of skill in the art, further details will not be described here. When it is no longer desirable to keep the spreader assembly 50 attached to the vehicle 10, the frame 52 may be detached from the vehicle 10. The spreader assembly 50 can then be easily stored on any appropriate ground surface 16 by simply placing the first, second, and third ground contacting surfaces 72, 74, 76 onto the ground surface 16. To then reuse the spreader assembly 50, it is only necessary to position the vehicle 10 near the spreader assembly 50 and then attach the frame 52 to the vehicle 10.

Numerous embodiments have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

We claim:

1. A spreader assembly comprising:

a frame that is attachable to an associated vehicle tailgate;

a hopper supported to the frame for use in holding an associated material;

a spinner mechanism supported to the frame and comprising: a motor and a spinner plate that (1) has a diameter D; (2) has a most distal surface; and, (3) is rotatable by the motor to spread the associated material held in the hopper onto an associated ground surface;

a spreader mount that: (1) comprises at least first, second, and third laterally spaced ground contacting surfaces that support the spreader assembly to the associated ground surface when the spreader assembly is detached from the associated vehicle; and, (2) remains attached to the spreader assembly when the spreader assembly is attached to the associated vehicle;

a spinner guard member that: (1) is supported to the frame; (2) at least partially encloses the spinner mechanism; (3) extends away from the associated vehicle when the spreader assembly is attached to the associated vehicle; (4) is substantially U-shaped having a lair of arms that are attached to the frame and a mid-section that comprises the first ground contacting surface; and, (5) has a most distal surface;

wherein distal is defined as a direction away from the vehicle when the spreader assembly is attached to the associated vehicle;

wherein the most distal surface of the spinner guard member is more distal that the most distal surface of the spinner plate;

wherein the most distal surface of the spinner guard is positioned below the spinner plate by a distance of at least D;

wherein the distal distance between the most distal surface of the spinner guard member and the most distal surface of the spinner plate is at least D/2;

wherein the second and third ground contacting surfaces are rectangular in shape;

wherein the second and third ground contacting surfaces have lengths greater than their widths; and, wherein a lengthwise axis of the second ground contacting surface is collinear with a lengthwise axis of the third ground contacting surface.

2. The spreader assembly of claim 1 wherein the hopper is formed substantially of polyethylene and the associated material is salt.

3. The spreader assembly of claim 1 wherein the spinner plate has a perimeter and the first, second and third ground contacting surfaces are laterally spaced outside the spinner plate perimeter.

4. The spreader assembly of claim 1 wherein:

the pair of arms are attached to the frame on opposite sides of the spinner mechanism; and, the spinner guard member is formed of a tubular member.

5. The spreader assembly of claim 1 wherein:

the frame comprises a main body and a bracket connected to the main body;

the spinner mechanism is connected to the bracket;

the spinner guard member is connected to the main body; and, the second and third ground contacting surfaces are formed on the lower ends of corresponding first and second legs that extend downwardly from the main body.

6. The spreader assembly of claim 1 wherein:

the spinner guard member is positioned completely below the spinner plate.

* * * * *